United States Patent [19]

Tanaka et al.

[11] 4,433,325

[45] Feb. 21, 1984

[54] OPTICAL VEHICLE DETECTION SYSTEM

[75] Inventors: Ryohei Tanaka, Osaka; Akinobu Kitamura; Takaaki Odake, both of Nagaokakyo; Yutaka Kato, Kyoto, all of Japan

[73] Assignee: Omron Tateisi Electronics, Co., Kyoto, Japan

[21] Appl. No.: 306,775

[22] Filed: Sep. 29, 1981

[30] Foreign Application Priority Data

Sep. 30, 1980 [JP] Japan ..... 55-137391
Oct. 6, 1980 [JP] Japan ..... 55-140105

[51] Int. Cl.[3] ..... G08G 1/00; G08G 1/04

[52] U.S. Cl. ..... 340/937; 250/222.1; 340/933; 340/942; 358/93; 358/108

[58] Field of Search ..... 340/38 R, 38 P, 31 C, 340/23; 358/93, 105, 107, 108; 346/107 VP; 250/206, 215, 216, 222 R, 222.1

[56] References Cited

U.S. PATENT DOCUMENTS

| | | | |
|---|---|---|---|
| 3,255,434 | 6/1966 | Schwarz | 340/38 |
| 3,685,012 | 8/1972 | Case et al. | 340/38 P |
| 4,173,402 | 11/1979 | Horike et al. | 340/38 P |
| 4,214,265 | 7/1980 | Olesen | 340/38 P |
| 4,258,351 | 3/1981 | Shigeta et al. | 340/38 P |

FOREIGN PATENT DOCUMENTS

| | | | |
|---|---|---|---|
| 54-125086 | 9/1979 | Japan | 340/38 P |

*Primary Examiner*—James J. Groody
*Attorney, Agent, or Firm*—Wegner & Bretschneider

[57] ABSTRACT

An optical vehicle detection system comprising camera means for catching the image of a vehicle running in a selected roadway lane to generate an output video signal, inquiring means for inquiring if the output video signal includes a predetermined shadow signal component, and processing means associated with the inquiring means, if the output video signal includes the predetermined shadow signal component, for processing the output video signal as a signal having a component of shadow cast by a vehicle.

6 Claims, 19 Drawing Figures

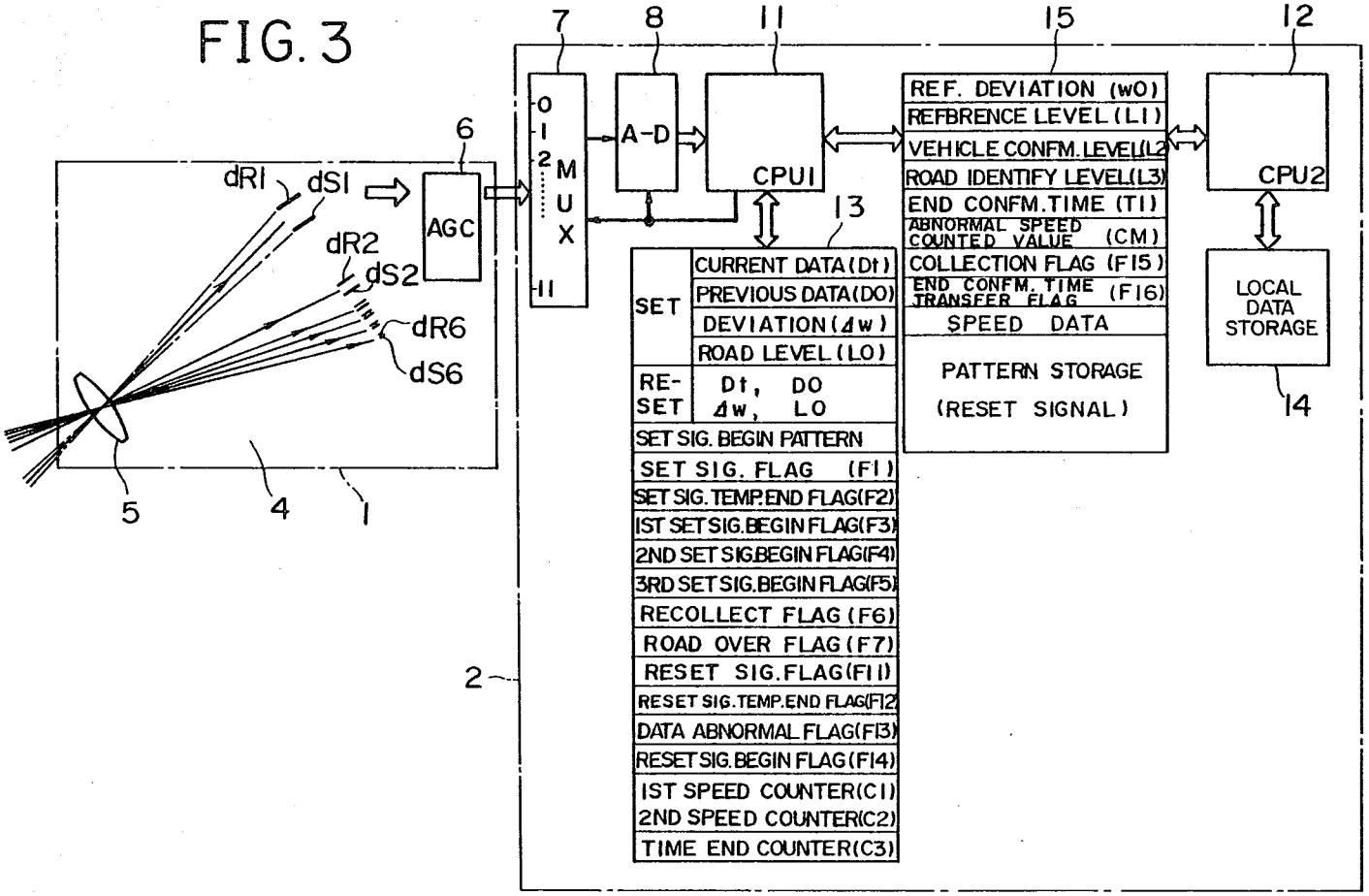
FIG. 3
CPU2
12
LOCAL DATA STORAGE
14
REF. DEVIATION (w0)
REFBRENCE LEVEL (L1)
VEHICLE CONFM. LEVEL(L2)
ROAD IDENTIFY LEVEL(L3)
END CONFM. TIME (T1)
ABNORMAL SPEED COUNTED VALUE (CM)
COLLECTION FLAG (F15)
END CONFM. TIME TRANSFER FLAG (F16)
SPEED DATA
PATTERN STORAGE (RESET SIGNAL)
15
CPU1
11
13
CURRENT DATA (Dt)
PREVIOUS DATA (D0)
DEVIATION (Δw)
ROAD LEVEL (L0)
SET
RE-SET
Dt, D0
Δw, L0
SET SIG. BEGIN PATTERN
SET SIG. FLAG (F1)
SET SIG. TEMP. END FLAG (F2)
1ST SET SIG. BEGIN FLAG (F3)
2ND SET SIG. BEGIN FLAG (F4)
3RD SET SIG. BEGIN FLAG (F5)
RECOLLECT FLAG (F6)
ROAD OVER FLAG (F7)
RESET SIG. FLAG (F11)
RESET SIG. TEMP. END FLAG (F12)
DATA ABNORMAL FLAG (F13)
RESET SIG. BEGIN FLAG (F14)
1ST SPEED COUNTER (C1)
2ND SPEED COUNTER (C2)
TIME END COUNTER (C3)
A-D
8
MUX
7
0
1
2
11
AGC
6
dR1
dS1
dR2
dS2
dR6
dS6
1
2
4
5

SET SIGNAL LO
RESET SIGNAL LO
4.8ms INTERRUPT
19.2ms INTERRUPT
ROAD OVER FLAG F7
SET SIGNAL FLAG F1
SET SIG.TEMP. END FLAG F2
1ST SET SIG.BEGIN FLAG F3
2ND SET SIG.BEGIN FLAG F4
3RD SET SIG BEGIN FLAG F5
RECOLLECTION FLAG F6
RESET SIG FLAG F11
RESET SIG.TEMP.END FLAG F12
DATA ABNORMAL FLAG F13
RESET SIG.BEGIN FLAG F14
COLLECTION FLAG F15
END CONFM TIME TRANSFER FLAG F16
L1
L2
A
B
T1

SET SIGNAL
RESET SIGNAL
4.8ms INTERRUPT
19.2ms INTERRUPT
ROAD OVER FLAG
SET SIGNAL FLAG
SET SIG.TEMP.END FLAG
1ST SET SIG. BEGIN FLAG
2ND SET SIG.BEGIN FLAG
3RD SET SIG.BEGIN FLAG
RECOLLECTION FLAG
RESET SIG. FLAG
RESET SIG.TEMP.END FLAG
DATA ABNORMAL FLAG
RESET SIG. BEGIN FLAG
COLLECTION FLAG
END CONFM TIME
TRANSFER FLAG
L0
F7
F1
F2
F3
F4
F5
F6
F11
F12
F13
F14
F15
F16
T1
CM
L3
L2
A
t

| | | | |
|---|---|---|---|
| PATTERN NUMBER | 2 | 3 | 3 |
| PATTERN GROUP | DECR/INCR | DECR/CONST/INCR | DECR/INCR/DECR |

| | | | |
|---|---|---|---|
| PATTERN NUMBER | 4 | 4 | 5 |
| PATTERN GROUP | DECR/INCR/CONST/DECR | DECR/CONST/INCR/DECR | DECR/CONST/INCR/CONST/DECR |

OPTICAL VEHICLE DETECTION SYSTEM

BRIEF SUMMARY OF THE INVENTION

This invention relates to an optical vehicle detection system which senses an optical image of a vehicle through an optical unit to generate an image signal and analyzes the generated image signal to provide a traffic information pertaining to a selected traffic lane, and more particularly to an improved optical vehicle detection system which precisely detects each vehicle in the selected traffic lane even if its image signal comprises a shadow component.

There is well known an optical vehicle detection system which includes an optical unit for forming an optical image of a predetermined point or area of a selected roadway on a photoelectric device disposed on the image plane thereof, and a processing unit for processing image signals generated by the photoelectric device so as to provide various traffic information, such as data on the speeds of vehicles, the number of vehicles, the distance between two adjacent vehicles, the degree of jamming of the traffic and so forth, relating to the selected road. Such a conventional optical vehicle detection system, however, has the disadvantage that the system may erroneously detect the noise of shadows cast by the vehicles in the selected traffic lane or/and its neighboring lane, so that the reliability of the system is adversely affected.

It is, therefore, a primary object of this invention to provide an optical vehicle detection system capable of discriminating the image signal of a vehicle from any shadow so as to detect the genuine image signal of the vehicle.

It is a further object of this invention to provide an optical vehicle detection system capable of discriminating between the shadow of any vehicle or vehicles in a selected lane and that cast by any vehicle or vehicles running in the neighboring lane so as to provide precise traffic information.

Other objects and advantages of this invention will be apparent upon reference to the following description in conjunction with the accompanying drawings, in which:

BRIEF DESCRIPTION OF DRAWINGS

FIG. 3 shows the construction of the optical vehicle detection system including the camera of FIG. 1;

DETAILED DESCRIPTION

The optical vehicle detection system described herein as a preferred embodiment of this invention employs an optical unit or camera having sufficient angle of view to cover a plurality of detection points on a selected lane so as to simultaneously receive traffic information at the respective detection points. This system is advantageous because such a camera is easy to be installed.

Figure 1:
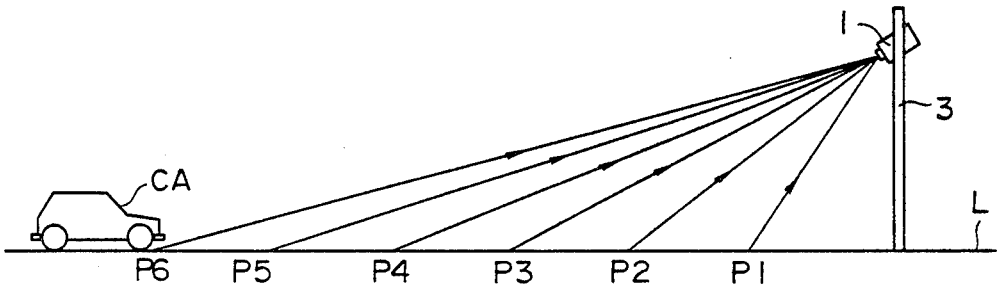
FIG. 1 illustrates the installation position of a camera employed in an optical vehicle detection system as a preferred embodiment of this invention.

Referring, now, to FIG. 1, the camera 1 is installed on a pole 3 at a predetermined elevation (e.g. 6 meters) above a roadway L so as to cover a predetermined distance (e.g. 100 meters) along the roadway L. As illustrated in FIG. 3, the camera 1 includes an optical system 4 which consists of an optical lens 5 and a plurality of pairs of photoelectric elements dS1·dR1 to dS6·dR6 arranged on the image plane of the optical system 4, said pairs corresponding to six detection points P1 to P6, respectively, in a selected traffic lane of the roadway L which are viewed by the camera 1. If it is desired to obtain traffic information on two traffic lanes through the camera 1, the camera 1 may be modified in such a manner that a plurality of pairs of photoelectric elements are arranged in dual lines.

Figure 2:
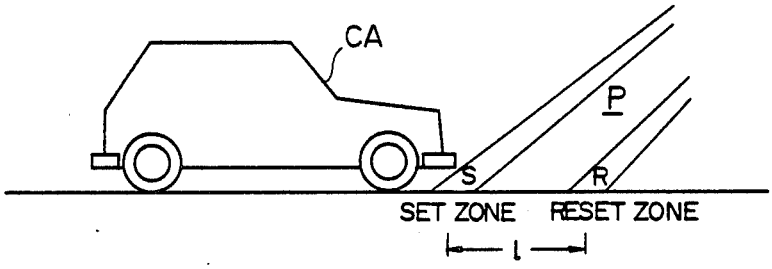
FIG. 2 is a detailed view of a detection point on a selected line of a traffic road.

As representatively illustrated in FIG. 2, each detection point P (P1 to P6 of FIG. 1) actually includes a set zone S and a reset zone R at a predetermined distance l from each other. Photoelectric elements dS (representing dS1 to dS6) and dR (representing dR1 to dR6) in pairs correspond to the respective zones S and R. If a vehicle CA passes through detection point P from set zone S to reset zone R, vehicle detection image signals are generated from the photoelectric element dS and, a time t later, from the element dR. The moving speed of the passing vehicle CA is computed based on the time t and the predetermined distance l.

Returning to FIG. 3, traffic information on vehicles in the selected traffic lane, such as the moving speeds of vehicles, vehicle intervals, degree of jamming of the traffic, the number of passing vehicles and the like is developed from a processing unit 2 based on image signals generated from the camera 1.

The output signals developed from the respective photoelectric elements dS (dS1 to dS6) and dR (dR1 to dR6) are amplified by an AGC (automatic gain control) amplifier 6, and applied to a multiplex channel device 7 so that the respective output signals from the twelve photoelectric elements are sequentially switched thereby for application to A-D converter 8. The A-D converter 8 converts the respective output signals from the photoelectric elements into digital signals at a predetermined time interval (e.g., 4.8 ms) for application to a central processing unit (hereinafter, briefly referred to as CPU) 11.

The processing unit 2 includes a pair of CPUs 11 and 12. The CPU 11 analyzes the image signals generated from the photoelectric elements dS1 to dS6 and dR1 to dR6 based on the data developed from the A-D converter 8, and controls the device 7 and converter 8. Based on the data developed from the CPU 11, the CPU 12 performs operations for computing a moving speed of a vehicle, detecting a traffic jam and so forth, and develops traffic information for transmission to an external center (not shown in the drawings) through a transmitter (not shown in the drawings). The CPUs 11 and 12 are coupled to program storages for storing execution programs (not shown in the drawings), and to local data storages 13 and 14, respectively. A common storage unit 15 is adapted to be accessible by both CPUs 11 and 12.

FIGS. 4A through 4G illustrate the image signals of vehicles generated from the photoelectric elements (dS and dR). The set and reset signal wave forms of the drawings are output image signals from the elements dS and dR, respectively.

Figures 4A, 4B, 4C, 4D:
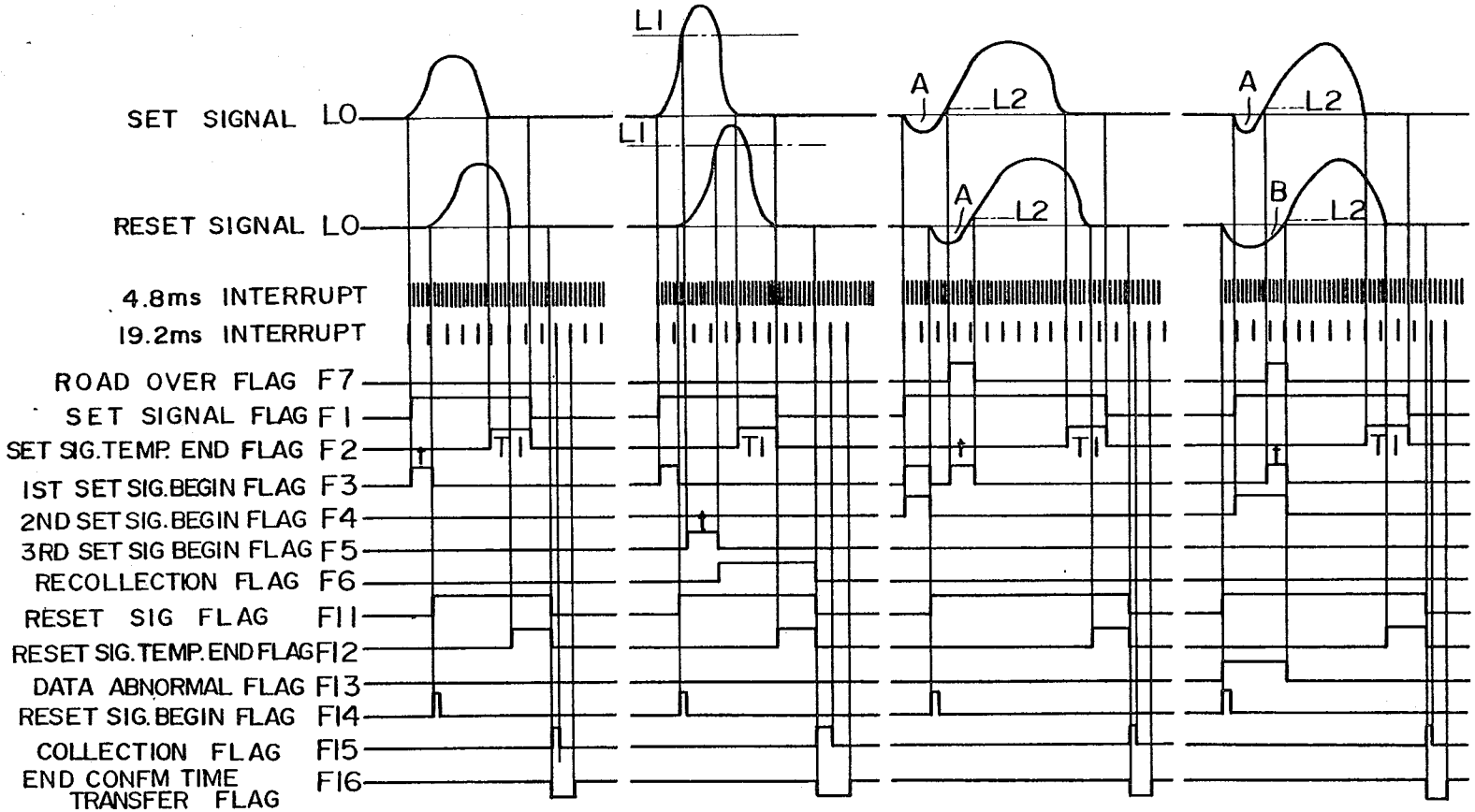
FIGS. 4A to 4G show various image signal wave forms and their associated time charts.

FIG. 4A illustrated typical image signals. Generally, since a light beam is reflected by a vehicle more intensely than by a road surface, the output from the photoelectric element, when the vehicle reaches the detection point P, becomes larger than a road surface level L0 which is the output potential from the photoelectric element sensing the road surface. As the vehicle leaves the detection point P, the output from the photoelectric element returns again to the road surface level L0. Assuming that a detection time t is an elapsed time from a rising time point of the set signal wave form to a rising time point of the reset signal wave form, the detection time t is the time which it took for the vehicle to travel from the set zones to the reset zone R over the distance l. Therefore, the moving speed V of the vehicle is obtained by the following equation:

$$V=K\cdot l/t$$

where K is a constant.

The actual distance over which the vehicle travels during the detection time t is not equal to the above-mentioned distance l because it is affected by the external shape and height of the vehicle. The moving speed of the vehicle, however, may be precisely measured by measuring a distance between the set and reset zones S and R on a detection plane which is assumed at a predetermined elevation above the road surface and statistically modifying the measured distance.

The signal wave forms illustrated in FIG. 4B have peaks at an extremely high level. There is provided a reference level L1. The time lag between time points when the set and reset signals respectively exceed on the reference level L1 is defined as a detection time t pertaining to the signal waves of FIG. 4B. Then, based on the detection time t, the moving speed V is obtained from the above-mentioned equation.

The signal wave forms at their initial portions illustrated in FIG. 4C comprise low signal components A below the road surface level L0, respectively. The signal components A represent shadow cast in front of or at the back of the vehicle. Since the intensity of the light beam from shadow portion is small, the signal pertaining to the shadow portion is lower than the road surface level L0. If the set and reset signals have such wave forms as illustrated in FIG. 4C, the time points when the set and reset signals exceed the road surface level L0 are detected so as to provide a time lag therebetween as the detection time t. In order to confirm if a signal component representing a vehicle follows the shadow signal component A, there is provided a vehicle confirmation level L2. The wave forms of FIG. 4C are examined as to if they have increased across the road surface level L0 and further exceeded the confirmation level L2. When the photoelectric elements sense the shadow cast by a vehicle running in the neighboring lane, it has been experimentally proved that they generate signal wave forms as illustrated in FIGS. 8A to 8F. The respective wave forms of FIGS. 8C to 8F are similar to the wave forms of FIG. 4C with respect to the forms that they include shadow components C below the road surface level L0 and subsequent signal components higher than the level L0. The subsequent signal components, however, do not exceed the vehicle confirmation level L2. Thus, by further confirming if the signal exceeds the level L2, it may be performed to discriminate the image signal of a vehicle from any shadow cast by any vehicle running in the neighboring lane.

The wave forms of FIG. 4D also include shadow signal components A and B. The reset signal, however, falls earlier than the set signal because the shadow signal component B of the reset signal represents the overlapped shadow of the vehicle running in the selected lane and the vehicle or vehicles running in the neighboring lane. The time points when the respective signals exceed the road surface level L0, strictly speaking the level L2, are detected so as to regard the time therebetween as detection time t.

Figures 4E, 4F, 4G:
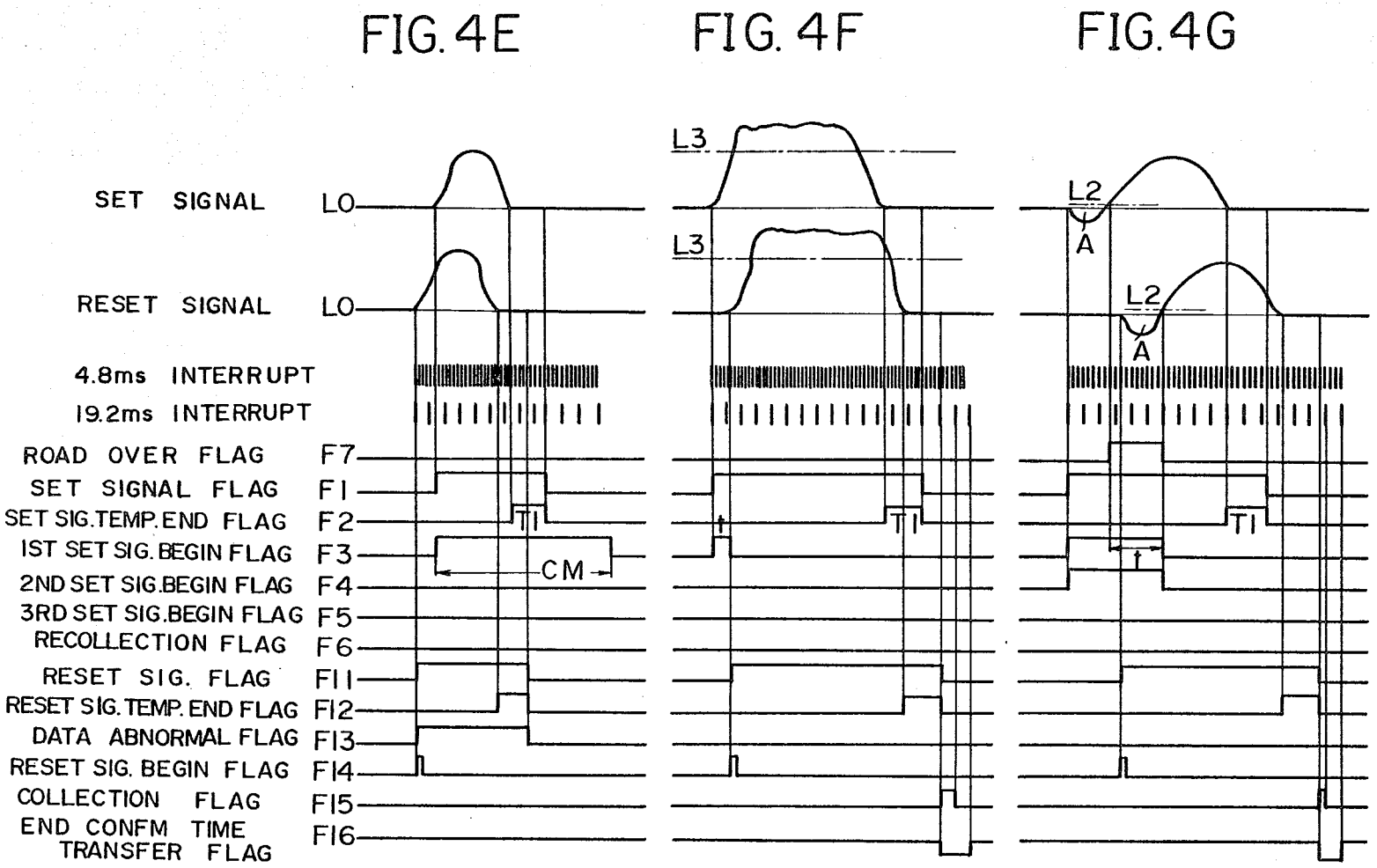

In FIG. 4E, the reset signal rises earlier than the set signal. These wave forms, however, cannot practically happen, and are processed as error signals, so that any detection time for computing moving speed is not measured.

FIG. 4F shows the signal wave forms representing a long body vehicle, such as bus, which passes on the detection point P. Each of the signal wave forms includes an increasing component rising from the road surface level L0, a flat component at a peak level and a decreasing component dropping to the level L0. In FIG. 4F, the time lag between the respective rising time points of the set and second signals is processsed as the detection time t. The state in which signal level does not rise nor drop is defined as "constant state". When any vehicle is not detected, the photoelectric elements keep output signals at the road surface level L0 and the constant state. The peak level of each signal of FIG. 4F also is in the constant state. Thus, there are two levels in the constant state, but there is provided a road surface identification level L3 therebetween so as to identify the two levels.

The signal wave forms illustrated in FIG. 4G include shadow signal components A representing shadow cast in front of or at the back of the vehicle as well as the wave forms of FIG. 4C. Though in FIG. 4C the time point when the reset signal starts to fall is earlier than the time point when the set signal crosses the road surface level L0, in FIG. 4G the two time points are vice versa. The detection time t is represented by the time lag between the time points when the set and reset signals cross the road surface level L0, respectively.

Figure 5:
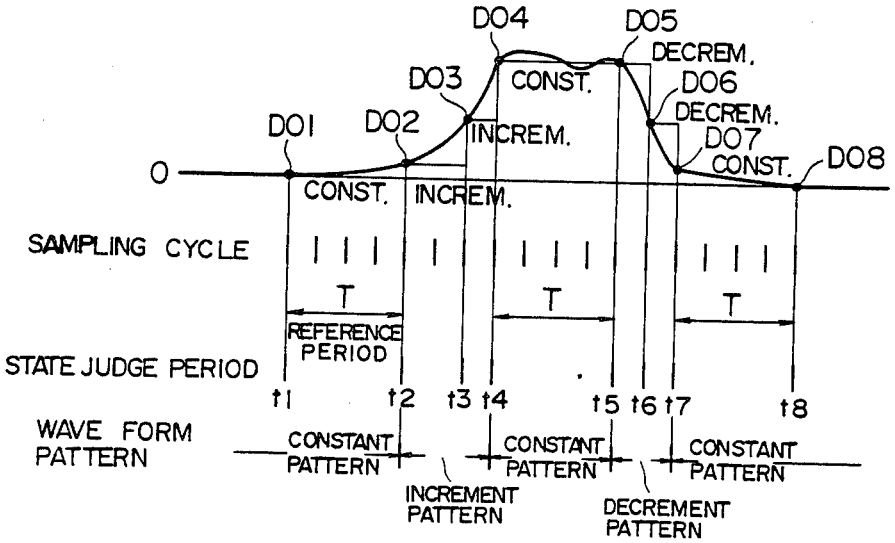
FIG. 5 illustrates the analysis of an image signal to obtain wave form patterns representing the image signal.

In this embodiment, in order to detect the rise and fall of the output signal wave forms generated from the photoelectric elements, the respective changes of the output signals are judged as illustrated in FIG. 5 which shows a typical image signal generated from the photoelectric elements of the camera 1 which catches a vehicle in the selected lane.

The input signals generated from the camera 1 are converted into digital data by the A-D converter 8 for each sampling cycle. The converted data in a current time is defined as a current data Dt. In order to judge the current data Dt to be in the increment, decrement or constant state, a deviation $\Delta\omega$ between the current data Dt and the former data must be obtained. The former data is represented by a previous processed data D0, such as a data which is formerly sampled and revised for each sampling cycle. For the above-mentioned judgement, a reference deviation $\omega 0$ is introduced so as to compare the deviation $\Delta\omega$ between the current data Dt and the previous processed data D0 therewith. Moreover, a reference time period T is introduced in this embodiment in such a manner that it is plural times, ex. four times, as long as the sampling cycle. In case that, by comparing a deviation $\Delta\omega$ with the reference deviation $\omega 0$ for each sampling cycle, the deviation $\Delta\omega$ is found to be greater than the reference deviation $\omega 0$ or in case that each reference time period has elapsed, the previous processed data is revised in such a manner that the previous processed data D0 is replaced with the current data Dt. If the rise or fall of the wave form of the input signal is a slow curve, some increment or decrement in the sampling cycle is within the reference deviation $\omega 0$. To detect such a slow curve, the reference time period T is employed and an inquiry is made as to whether the change within the reference time period T reaches the reference deviation $\omega 0$. The change of the input signal are classified to increment state, decrement state, and constant state wherein there is no increment nor decrement. If $Dt-D0 \geqq \omega 0$ within reference time period T, the change of the signal until then is judged to be the increment state. If $Dt-D0 \geqq -\omega 0$ within the period T, the change until then is judged to be decrement state. Then, the current data Dt is employed as new previous processed data D0. If $1Dt-D01 < \omega 0$ in the reference time period T, the change within the period T is judged to be the constant state and the current data Dt is entered as a new previous processed data D0.

With reference to the wave form of FIG. 5, the above-mentioned operations are explained in detail. Until time point t1, any vehicle is not detected and the previous processed data D01 is zero. At time point t2 in reference time period T, the deviation $\Delta\omega = Dt - D01$ is below the reference deviation $\omega 0$. Then, the change of the wave form between time points t1 and t2 is in constant state, and the current data Dt at the time point t2 is registered as previous processed data D02. Though in the subsequent sampling cycle the deviation $\Delta\omega = Dt - D02$ does not reach the reference deviation $\omega 0$, in further subsequent sampling cycle, viz. at the time point t3, it is greater than the deviation $\omega 0$. Then, the change between the time points t2 and t3 is in increment state, and the current data is registered as a previous data D03. Moreover, increment state (t3–t4), constant state (t4–t5), decrement state (t5–t6, t6–t7) and constant state (t7–t8) are obtained, and the respective previous processed data are sequentially revised in the order of D04 to D08. The wave form of FIG. 5 consists of five wave from patterns as illustrated at the bottom of the drawing. By analyzing the input signal wave forms into such wave form patterns and comparing them with the wave patterns illustrated in FIGS. 8A to 8F, the input signals can be judged to represent shadow cast by a vehicle running in the neighboring lane or not.

Returning to FIG. 3 and FIGS. 4A to 4G, operations for processing the output image signals generated from the photoelectric elements are explained hereinafter. The storage unit 13 includes storage areas for storing current data Dt, previous processed data D0, deviations $\Delta\omega$ and road surface levels L0 of set and reset signals and a storage area for storing a beginning pattern of a set signal. The beginning pattern represents the change (increase or decrease) of the set signal after a predetermined time (end confirmation time T1) during which the set signal keeps constant state at the road surface level L0 has elapsed. This pattern is used to confirm whether a vehicle detection signal starts along a rising or falling curve. The end confirmation time T1 is employed to confirm that a vehicle has passed a detection point so as to distinctly discriminate each vehicle.

The storage unit 13 further includes storage areas for various flags. Set signal flag F1 and reset signal flag F11 represent that a vehicle is running in set zone S and reset zone R and vehicle detection signals are generated, respectively. The respective flags are set during the time when the output signals from the photoelectric elements in the set and reset zones rise or fall from the road surface level L0, variously change, return to constant state at the road surface level L0 and are kept at the level L0 during the end confirmation time T1. Set signal temporary end flag F2 and reset signal temporary end flag F12 represent that the respective end confirmation times T1 for set and reset signals are for counting. The flags F2 and F12 are set when the signals return to the road surface level L0 for entering into constant state, and reset when the end confirmation times T1 have elapsed. A first set signal beginning flag F3 represents that a detection time t (vehicle moving speed) is computed. The flag F3 is set when the set signal rises or falls from the road surface level L0 or crosses the road surface level L0 in an increment state, and reset when the reset signal rises or falls from the road surface level L0 or crosses the level L0 in an increment state. Second set signal beginning flag F4 represents that signal components A and B pertaining to shadow of vehicle are under measurement. The flag F4 is set when set signal falls from the road surface level L0, and reset when the reset signal falls from the level L0 or crosses the level L0 in an increment state. Third beginning flag F5 represents that a detection time t is computed on the basis of the reference level L1. The flag F5 is set when set signal crosses the reference level L1 in an increment state, and reset when reset signal crosses the level L1 in an increment state. Recollection flag F6 represents that a detection time t has been measured on the basis of the reference level L1. The flag F6 is set when the third beginning flag F5 is set and the reset signal crosses the level L1 in an increment state, and reset when the reset signal returns to the road surface level L0 and the end conformation time T1 has elapsed. A road surface over flag F7 is set when after the set signal initially fell below the road surface level L0, it rises over the level L0, and represents that the set signal has risen over the level L0. The flag F7 is reset when the reset signal rises over the level L0 aften initial fall. A data abnormal flag F13 is set when the order of rise or fall or the set and reset signals is reverse. A reset signal beginning flag F14 is set when reset signal begins to initially rise or fall, but immediately reset.

The storage unit 13 further includes areas for a first vehicle speed counter C1, a second vehicle speed counter C2 and time end counter C3. The first vehicle speed counter C1 counts detection time t on the basis of the road surface level L0. When a set signal begins to rise or fall from the road surface level L0 or in an increment state crosses the level L0, the counter C1 is reset and begins to count a time. The second vehicle speed counter C2 counts detection time t on the basis of the reference level L1, and when set signal in an increment state crosses the level L1, is reset. The counters C1 and C2 may be formed on a signal area. The time end counter C3 counts end confirmation time T1. The counter C3 is actually provided for each of set signal and reset signal, but for simplified explanation, is illustrated as one counter. If the set signal flag F1 (or reset signal flag F11) is set and the set signal temporary end flag F2 (or reset signal temporary end flag F12) is reset, when the set signal (or reset signal) reaches the constant state at the road surface level L0, the counter C3 is reset and begins to count time.

The common storage unit 15 includes storage areas for storing reference deviation ω0, reference level L1, vehicle confirmation level L2, road surface identification level L3, end confirmation time T1 and abnormal speed counted value. For instance, when one of the photoelectric elements detects shadow cast by a vehicle running in the neighboring lane, the output signal therefrom falls from the road surface level L0, variously changes and returns to the level L0. When the output signal returns to the level L0, however, it temporarily goes over the road surface level L2 to some extent due to characteristics of circuits (particularly, the amplifier 6) as illustrated in FIGS. 8C through 8F. The vehicle confirmation level L2 is defined so as to be slightly higher than the maximum level of the signal representing such shadow but close to the road surface level L0 as long as possible. If the output signal from the photoelectric element goes over the level L2 in an increment state, the signal is judged to pertain to a vehicle and have gone over the road surface level L0. It is not normal state that the vehicle counters C1 and C2 continue to count as long as it likes without any reset. This abnormal state occurs, for instance, when reset signal is generated prior to the set signal or set signal is added by noise so as to make the counters C1 and C2 start counting. The abnormal speed counter value CM is defined to be slightly larger than the counter values of the vehicle counters C1 and C2 which count vehicles at the most likely slow speed. When the counted values of the counters C1 and C2 exceed the counted value CM, the measuring process ceases as abnormal state.

The storage unit 15 further includes areas for collection flag F15 and end confirmation time transfer flag F16. The collection flag F15 represents the completion of measuring the vehicle speed. When data abnormal flag F13 is set and the end confirmation time T1 of the reset signal has elapsed, the flag F15 is set. When the flag F15 is set, the CPU 12 reads the speed data stored in a speed data area of the storage unit 15. If the CPU 12 completes reading the stored speed data, the flag F15 is reset. The end confirmation time transfer flag F16 is reset when the end confirmation time T1 of reset signal has elapsed. The CPU 12 is designed to decide the end confirmation time T1 on the basis of the read speed data and change the time T1 for each vehicle speed measurement. IF the CPU 12 transfers the end confirmation time T1 into the common storage unit 15, the flag 16 is set. The end confirmation time T1 is defined to be short time on fast measured speed and long time on slow measured speed.

Moreover, the storage unit 15 includes a speed data storage area for storing the speed data transferred from the vehicle counters C1 and C2 and a pattern storage area for storing the changes of wave forms of reset signals. The data stored in the pattern storage area are used in various wave form pattern processing.

Figure 6:
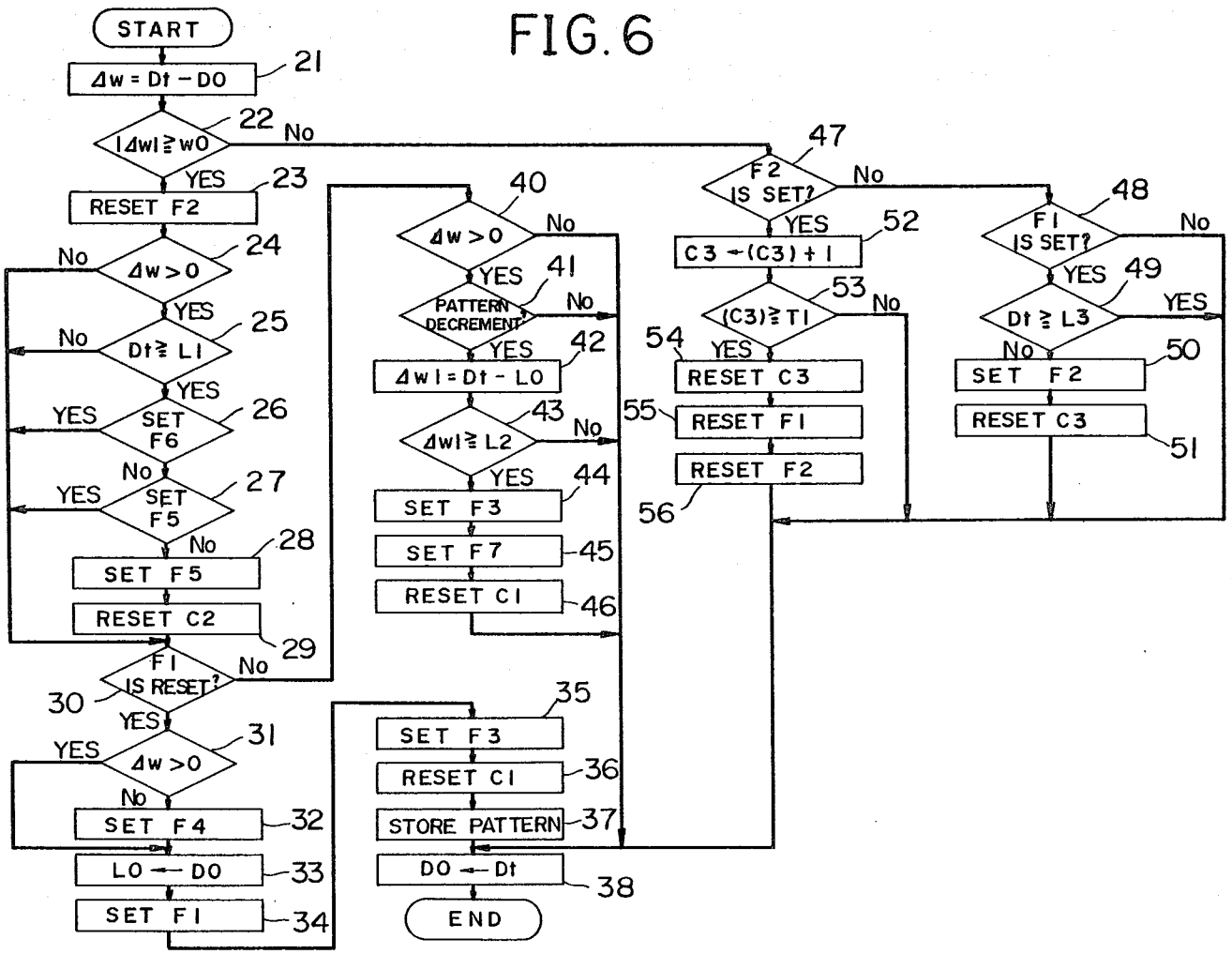
FIG. 6 shows a flow chart illustrating operations for processing a set signal.

FIG. 6 illustrates the operations for analyzing a set signal which are performed by the CPU 11. These operations are performed every 4.8 milliseconds. Initially, the current data Dt which is converted into digital data is read out and a deviation Δω is obtained by subtracting the previous processed data D0 from the read current data Dt (step 21). The absolute value of the deviation Δω is compared with the reference deviation ω0 so as to judge if the change of the set signal is increment, decrement or constant (step 22). If the change is increment or decrement, the set signal temporary end flag F2 is reset (step 23). The flag F2 is always reset when the set signal is in an increment or decrement state. If the flag F2 is set when the signal moves from constant state to increment or decrement state, it is turned off.

By inquiring if the deviation Δω is plus, the set signal is judged to be in an increment state or a decrement state (step 24). If the deviation Δω is plus, viz. increment state, it is inquired if the current data Dt is not lower than the reference level L1 (step 25). If the current data Dt≧the level L1, an inquiry is made as to if the second collection flag F6 is set (step 26). If the flag F6 is reset, it is inquired if the third beginning flag F5 is set (step 27). If the current data Dt is not lower than the reference level L1, viz. YES response to the step 25, and the flags F6 and F5 are reset, it represents that the set signal has initially crossed the reference level L1 after it began to rise as illustrated in FIG. 4B. Then, the third beginning flag F5 is set (step 28), and the second vehicle speed counter C2 is reset (step 29). Then, as described later, the second vehicle counter C2 begins to count the detection time t. If there is a NO response from the step 24 or 25 or a YES response from the step 26 or 27, the sequence advances to step 30 to which the sequence also advances from the step 29.

It is inquired if the set signal flag F1 is reset (step 30). Since the change of the set signal should be increment or decrement as judged in the step 22, a YES response from the step 30 represents that the set signal began to rise or fall. Then, it is again inquired whether the set signal is in an increment or decrement state (step 31). If Δω≦0, viz. decrement, the set signal is falling and the second set signal beginning flag F4 is set (step 32) (see FIGS. 4C and 4D). If Δω>0, viz. increment, the sequence flows from step 31 to step 33.

The road surface level L0 in this embodiment is renewed every vehicle detection. Through the renewal timing of the road surface level L0 may be anytime except detecting vehicles, the level L0 is herein renewed when a vehicle is begun to be detected, viz. when a set signal initially begins to rise or fall from a constant state at the road surface level L0 (in which a YES response from the step 30 should be available). In the step 33, the previous processed data (D0) replaces the road surface level L0 as a new road surface level L0.

Then, the set signal flag F1 is set (step 34), the set signal beginning flag F3 is set (step 35), and the vehicle speed counter C1 is reset for measuring the detection time t (step 36). Thus, the counter C1 becomes ready for counting. Moreover, a transitional pattern (increment or decrement) of the set signal when a vehicle in begun to be detected is stored (step 37), and the previous processed data D0 is renewed by the current data Dt as a new previous processed data D0 (step 38).

If the set signal flag F1 has been set in the step 30, a NO response from step 30 is applied to a step 40 in which an inquiry is made as to whether the change of the set signal is increment or decrement. If the change is increment in the step 40, an inquiry is made as to if the transitional pattern at the beginning of the detection signal is decrement so as to confirm the possibility that the set signal in the increment state crosses the road surface level L0 as illustrated in FIGS. 4C, 4D and 4G (step 41). If the pattern at the beginning is decrement, it is assumed that the set signal at the beginning of vehicle detection falls below the road surface level L0 as illustrated by the shadow signal components A and B of FIGS. 4C, 4D and 4G and thereafter the signal rises up (YES response from the step 40). Therefore, the deviation $\Delta\omega 1$ is obtained by subtracting the road surface level L0 from the current data (Dt) (step 42) and an inquiry is made as to if the deviation $\Delta\omega 1$ is not less than the vehicle confirmation level L2 (step 43) so as to inquire if the set signal is over the level L2. If the deviation $\Delta\omega 1$ is not less than the level L2, the set signal is regarded that it rises over the level L0 and is the signal pertaining to a detected vehicle. Then, the set signal beginning flag F8 is set (step 44), the road surface over flag F7 is set (step 45), and the vehicle speed counter C1 is reset so as to be ready for counting the detection time t (step 46). Thereafter or if there is generated a NO response from the step 40, 41 or 43, the sequence flows to a step 38. Thus, the counter C1 is reset when the signal begins to rise or fall from the road surface level L0 (step 36) and when the set signal crosses the level L0 (step 46).

If the set signal is in a constant state (step 22), a NO response from the step 22 is applied to an inquiry step 47. As described hereinabove, an inquiry as to whether the signal is in a constant pattern may be made every sampling cycle or reference time period. If such an inquiry is made every reference time period, the sequence flows to the step 47 every response time period as long as the set signal is in a constant state. A NO response from the step 47 in which the set signal temporary end flag F2 is reset represents that the set signal is in a constant state at a peak level as illustrated in FIG. 4F because of vehicle detection or in a constant state at the road surface level L0 because of no vehicle detection. The NO response is applied to a step 48 in which an inquiry is made as to if the set signal flag F1 is set. A NO response from the step 48 represents that the set signal in the constant state at the level L0, and is applied to the step 38 for renewing the previous data D0 with the current data Dt.

A YES response from the step 48 represents that the constant state is at a peak level or the moment when the set signal has just fallen to the constant state at the level L0 from a decrement state. Then, it is inquired if the current data Dt is not lower than the road surface identifying level L3 (step 49). If the current data Dt is equal to or larger than the level L3, the sequence flows to the step 38. A NO response from the step 49 in which the current data Dt is smaller than the level L0 represents that the set signal has just reached the level L0. Then the set signal temporary end flag F2 is set (step 50), the end time counter C3 is reset for the preparation that the counter C3 starts to count an end elapsing time, and the sequence flows to the step 38.

A YES response from step 47 in which the set signal temporary end flag F2 is set is applied to a step 52 in which the time end counter C3 counts one. Then, the counted value of the counter C3 is compared with the end confirmation time T1 (step 53). If the value of the counter C3 is smaller than the time T1, the sequence flows to the step 38. If it reaches or has reached the time T1, the counter C3 is reset (step 54). Then, the set signal flag F1 is reset (step 55), the set signal temporary end flag F2 is reset (step 56), and the sequence flows to the step 38. Thus, the operations for set signals are finished.

Figure 7:
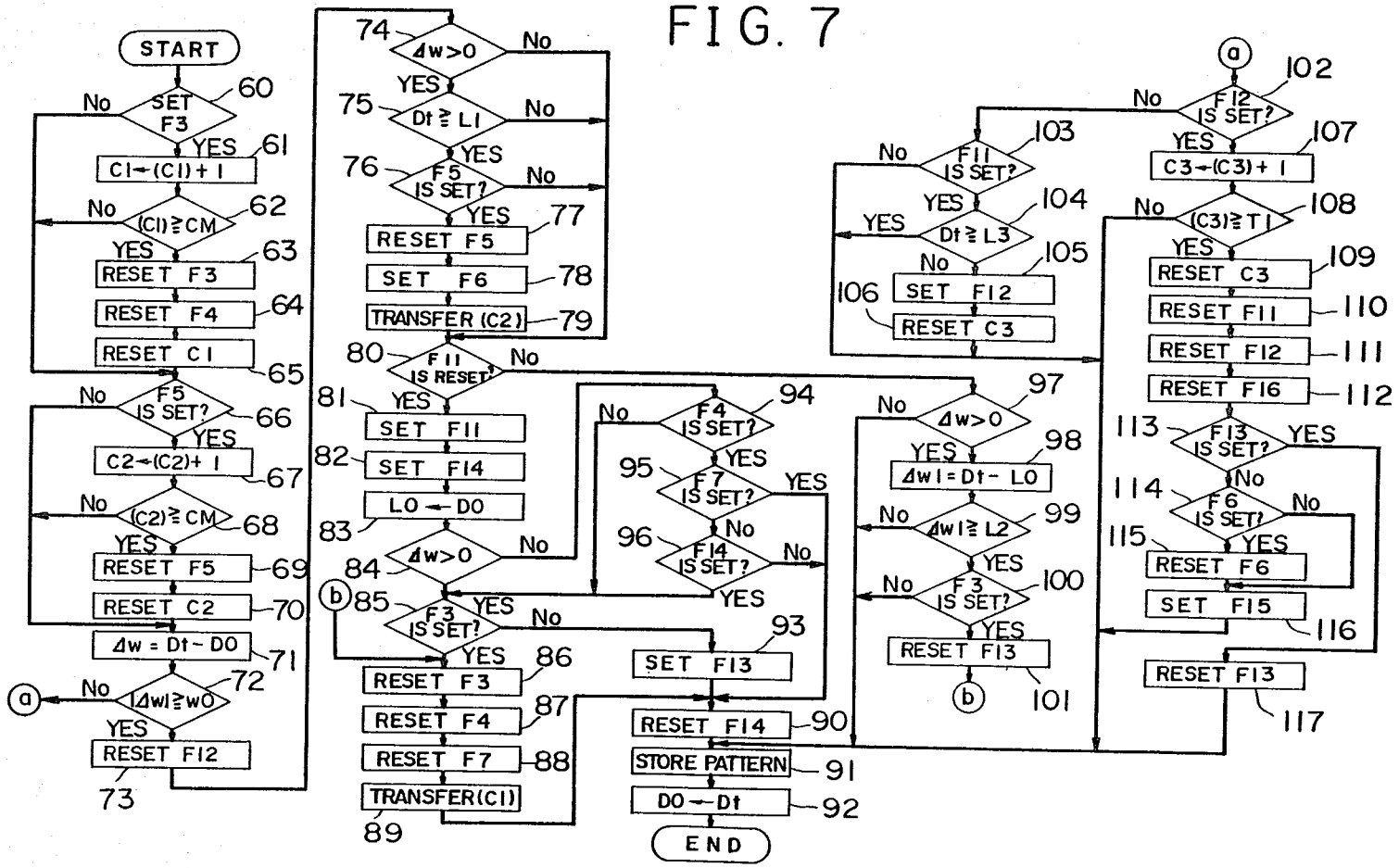
FIG. 7 shows a flow chart illustrating operations for processing a reset signal.
Figures 8A, 8B, 8C:
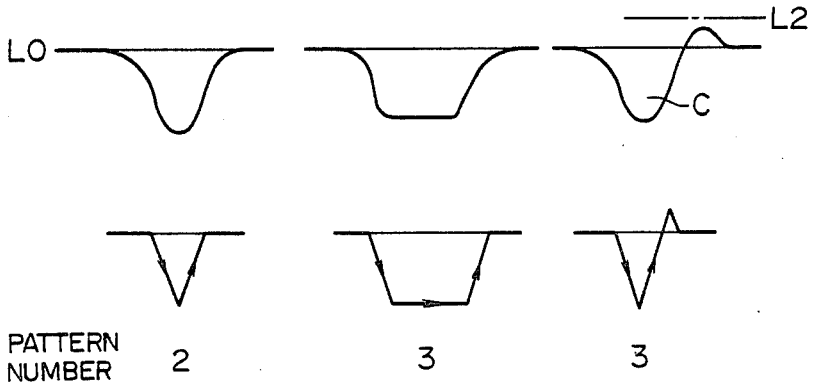
FIGS. 8A to 8F show wave forms of various shadow signals.
Figures 8D, 8E, 8F:
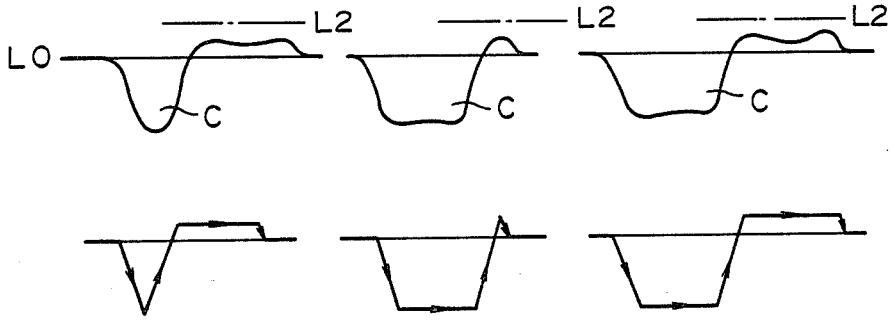

FIG. 7 illustrates operations for processing reset signals. A series of these operations is performed every 4.8 milliseconds. Initially, the first set signal beginning flag F3 is inquired as to whether it is set or reset (step 60). If the flag F3 is set, the vehicle speed counter C1 is allowed to count one for counting the vehicle speed (detection time t) (step 61). Then, an inquiry is made as to whether the counted value of the counter C1 is equal to or larger than the abnormal speed counted value CM (step 62). A YES response from the step 62 represents that an abnormal data exists (see FIG. 4E). The first set signal beginning flag F3 is set when the set signal begins to rise or fall or when the set signal crosses the road surface level L0. The second set signal beginning flag F4 is set when the set signal begins to fall from the level L0. Then, when these flags F3 and F4 are set, the counter C1 is reset for beginning to measure a vehicle moving speed.

When the YES response is generated from the step 62, the flags F3 and F4 are reset (stpes 63 and 64) and the counter C1 is reset (step 65) so as to stop the vehicle speed measurement. It is desirable that the reset signal is judged to be normal or abnormal by checking the width of the reset signal.

Then, the third set signal beginning flag F5 is inquired as to whether it is set or reset in a step 66. If the flag F5 is set, the second vehicle speed counter C2 counts one for counting the vehicle speed (detection time t) (step 67). In the same manner as the operations after the step 62, if the counted value of the counter C2 is equal to or larger than the abnormal value CM (viz. YES response from the step 68), the third set signal beginning flag F5 is reset (step 69) and the second vehicle speed counter C2 is reset (step 70).

After the above-mentioned vehicle speed counting operations, a deviation $\Delta\omega$ is obtained by subtracting the previous processed data D0 from the current data Dt (step 71). Then, it is inquired if the absolute value of the deviation $\Delta\omega$ is equal to or larger than the reference deviation $\omega 0$ (step 72). A YES response ($|\Delta\omega| \geqq \omega 0$) therefrom represents that the reset signal is in an increment state or a decrement state, and is applied to step 73 in which the reset signal temporary end flag F12 is reset (step 73). Then, an inquiry is made as to if it is increment or decrement (step 74). If it is increment, a further inquiry is made as to if the current data Dt has reached the reference level L1 (step 75). If there is a YES response in the step 75, an inquiry is made as to whether the third beginning flag F5 is set (step 76). The fact that the current data Dt is equal to or larger than the reference level L1 and the flag F5 is set means that the reset signal has reached the reference level L1. Therefore, in order to finish counting the vehicle speed, the flag F5 is reset (step 77), and the recollection flag F6 is set (step 78) (see FIG. 4B). Then, the contents of the second vehicle speed counter C2 are transferred to a speed data area of the storage unit 15 (step 79). A NO response from the step 74, 75 or 76 is applied to step 80.

In the step 80, it is inquired if the reset signal flag F11 is reset. Since the reset signal is in increment state or decrement state, if the reset signal flag F11 is reset, the moment at the step 80 is the time point when the reset signal initially falls or rises from the road surface level L0. Then, the reset signal flag F11 and the reset signal beginning flag F14 are set, respectively (steps 81 and 82). The previous data D0 at the time is stored as the road surface level L0 (step 83). In a step 84, it is inquired if the change of the reset signal is increment so as to judge the reset signal to be rising or falling. If the deviation $\Delta\omega$ is plus, there is generated a YES response from the step 84 representing that the signal is rising. Then, if the first set signal beginning flag F3 has already been set, the measurement for vehicle speed is available (see FIG. 4A), but if the flag F3 is not yet set, it is abnormal (see FIG. 4E). To confirm if the reset signal is normal, an inquiry is made as to if the flag F3 is set (step 85). If the flag F3 is set, the reset signal is normal. Then, since the detection time t has been measured, the flag F3 is reset (step 86), the second set signal beginning flag F4 is reset (step 87), the road surface over flag F7 is reset (step 88), and the contents of the first vehicle speed counter C1 are transferred to speed data area of the storage unit 15 (step 89). Moreover, the reset signal beginning flag F14 is reset (step 90), the change of the wave form is stored in the pattern storage area of the storage unit 15 as a basic data (step 91), the previous data D0 is renewed by the current data Dt (step 92), and the sequence is finished.

If the first set signal beginning flag F3 is reset in the step 85, it is abnormal. Then, the data abnormal flag F13 is set (step 93) (see FIG. 4E), and the sequence flows to the step 90 without transferring the contents of the counter C1.

If the reset signal is in decrement state in the step 84, there is generated a NO response representing that the reset signal includes a shadow signal component as illustrated in FIGS. 4C, 4D and 4G, and is applied to step 94 in which an inquiry is made as to whether the second signal beginning flag F4 is set. A NO response from the step 94 is applied to the step 85, and the NO response from the step 85 is applied to the step 93 for setting the abnormal flag 13 without transferring contents of the counter C1 because the step 89 is skipped. If the second set signal beginning flag F14 is set in the step 94, an inquiry is made as to if the road surface over flag F7 is set (step 95). The inquiry about the flag F7 is employed to discriminate the reset signals illustrated in FIGS. 4C and 4G. If the flag F7 is reset in the step 95, the reset signal is the wave form illustrated in FIG. 4C and an inquiry is made as to whether the flag F14 is set (step 96). If the flag F14 is set, the sequence flows to the step 85. If the first set signal beginning flag F3 is set, the contents of the counter C1 are transferred into the speed data area of the storage unit 15 (step 89). The transferred contents of the counter C1 represent the time from the falling time point of the set signal to the falling time point of the reset signal, but are later revised by the detection time t from the time point wherein the set signal crosses over the road surface level L0 to the time point wherein the reset signal crosses over the level L0. If the road surface flag F7 is set in the step 95 (FIG. 4G), it shows that the set signal has already crossed the level L0 and the detection time t is under measurement. Then, the sequence advances to the step 90 without the steps 86 to 89.

If the reset signal flag F11 is set in the step 80, the reset signal has already begun to rise or fall. Then, it is inquired if the reset signal is in an increment (step 97). If the deviation $\Delta\omega$ is plus, viz. the signal is in an increment, the difference $\Delta\omega 1$ between the current data Dt and the road surface level L0 is obtained (step 98). The difference $\Delta\omega 1$ is inquired if it is equal to or larger than the vehicle confirmation level L2 (step 99). If the difference $\Delta\omega 1$ is not smaller than the level L2 (step 99) and the first set signal beginning flag F3 is set (step 100), the data abnormal flag F13 is reset (step 101) (see FIG. 4D) and the sequence flows to the step 86. Then, the flags F3, F4 and F7 are reset, and the detection time t (viz. the contents of the counter C1) which is counted since the time point wherein the set signal crossed over the road surface level L0 is transferred to the speed data area of the unit 15 (see FIGS. 4C, 4D and 4G) (steps 86 to 89). NO responses from the steps 97, 99 and 100 are applied to the step 91.

If the reset signal is in a constant state, there is generated a NO response from the step 72, and the NO response is applied to an inquiry step 102 as to the reset signal temporary end flag F12. If the flag F12 is reset, the reset signal flag F11 is inquired as to whether it is set (step 103). If the flag F11 is reset, the sequence flows to the step 91 because the road surface is already detected. If the flag F11 is set in the step 103, there is the possibility that the reset signal has just begun to be in an constant state at the road surface level L0. Then, if the current data Dt is smaller than the road surface identifying level L3 (step 104), the reset signal temporary end flag F12 is set so as to regard that the reset signal has returned to the road surface level L0 (step 105), the counter C3 is reset to count a time elapsing after the end (step 106), and the sequence flows to the step 91. If the current data Dt is equal to the level L3 or more in the step 104, it shows the constant state at a peak level as illustrated in FIG. 4F, and the sequence flows to the step 91.

If the reset signal temporary end flag F12 is set in the step 102, the time end counter C3 counts one count to measure time elapsing after the end of the reset signal (step 107). If the counted value of the counter C3 does not reach the end confirmation time T1 (step 108), the sequence flows from the step 108 to the step 91. If the value reaches or has reached the time T1 (step 108), the counter C3 is reset (step 109), the flags F11 and F12 are reset (steps 110 and 111), the end confirmation time transfer flag F16 is reset (step 112). Then, if the data abnormal flag F13 is set (step 113), the sequence jumps to a step 117 in which the flag F13 is reset. If the flag F13 is reset in the step 113, the sequence is normal and advances to a step 114 to inquire if the recollection flag F6 is set. A YES response from the step 114 represents a speed measurement based on the reference level L1, and is applied to a step 115 in which the flag F6 is reset, if necessary, after performing predetermined operations as to the data based on the reference level L1. The collection flag F15 is set (step 116). Even if the flag F6 is reset in the step 114, the flag F15 is set. Thus, the sequence flows to the step 91.

The CPU 12 reviews the state of the collection flag F15 every 19.2 milliseconds, and, if the flag F15 is set, reads the detection time data stored in the speed data area of the storage unit 15 so as to perform predetermined operations, such as computation of the vehicle moving speed, computation of the degree of jamming of the traffic and so forth. The CPU 12 resets the flag F15 after reading the detection time data from the storage unit 15. If the end confirmation time transfer flag F16 is reset, the CPU 12 transfers to the unit 15 the end confirmation time computed based on the vehicle moving speed of the previously running vehicle so as to revise the time in the unit 15. Then, the flag F16 is set.

According to this embodiment, the respective wave forms of FIGS. 8A to 8F can be judged to be the wave forms pertaining to shadow cast by a vehicle or vehicles running in a neighboring lane. This embodiment, however, may be modified in such a manner that the symbolized patterns, or the respective pattern numbers and pattern groups, illustrated in FIGS. 8A to 8F are stored in the optical vehicle detection system and they are compared with the input signals generated from the camera 1 so as to discriminate the image signal of a vehicle from any shadow, particularly that cast by any vehicle or vehicles running in the neighboring lane. In the modification, the input signals are analyzed into wave form patters as illustrated in FIG. 5 for the comparison with the stored symbolized patterns.

Thus, according to the present invention there is provided an optical vehicle detection system which can detect the genuine image signal of the vehicle running in a selected lane and precisely measure a detection time, viz. vehicle running speed and traffic information, being adversely affected by shadow components.

It should be understood that the above description is merely illustrative of the present invention and that many changes and modifications may be made by those skilled in the art without departing from the scope of the appended claims.

What is claimed is:

1. An optical vehicle detection system comprising:
camera means for catching the image of a vehicle running in a selected roadway lane to generate an output video signal,
inquiring means for inquiring if said output video signal includes a predetermined vehicle shadow signal component, and
processing means associated with said inquiring means, for processing said output video signal as a signal having a component of shadow cast by a vehicle, when said output video signal includes the predetermined shadow signal component.

2. A system according to claim 1 in which said predetermined shadow signal component is a wave decreasing at the beginning thereof from a predetermined road surface level.

3. A system according to claim 1 in which said predetermined shadow signal component is one of predetermined signal wave form patterns representing shadow cast by a vehicle running in a neighboring roadway lane.

4. A system according to claim 1 further including means for confirming if said output video signal including the predetermined shadow signal component exceeds a predetermined vehicle confirmation level.

5. An optical vehicle detection system comprising:
camera means for catching the image of a vehicle running in a selected roadway lane to generate an output video signal;
inquiring means for inquiring if said output video signal includes a predetermined vehicle shadow signal component, said inquiring means comprising;
sampling means for sampling said output video signal every sampling cycle so as to generate a current data,
comparing means for comparing a reference deviation with a deviation obtained by subtracting a previous processed data from said generated current data,
detecting means for detecting a wave form pattern of said output video signal as to increment, decrement and constant states; and
processing means associated with said inquiring means, for processing said output video signal as a signal having a component of shadow cast by a vehicle when said output video signal includes the predetermined shadow signal component.

6. An optical vehicle detection system comprising:
camera means for catching the image of a vehicle running in a selected roadway lane to generate an output video signal,
inquiring means for inquiring if said output video signal includes a predetermined vehicle shadow signal component, and
processing means associated with said inquiring means, for processing said output video signal as a signal having a component of shadow cast by a vehicle when said output video signal includes the predetermined shadow signal component, and
said processing means having means for memorizing said output video signal which includes a predetermined vehicle shadow component and having means for detecting as a detection time a time difference between the time points when a set signal and reset signal are respectfully generated as vehicle crosses a road surface.

* * * * *